United States Patent [19]

Oosterkamp et al.

[11] B 3,986,064

[45] Oct. 12, 1976

[54] ROTARY-ANODE X-RAY TUBE

[75] Inventors: Wijbe Johannes Oosterkamp, Eindhoven, Netherlands; Dieter Marschall, Hamburg, Germany

[73] Assignee: U.S. Philips Corporation, New York, N.Y.

[22] Filed: Oct. 10, 1974

[21] Appl. No.: 513,706

[44] Published under the second Trial Voluntary Protest Program on January 13, 1976 as document No. B 513,706.

[30] Foreign Application Priority Data

Oct. 15, 1973 Netherlands ..... 7314131

[52] U.S. Cl. ..... 313/60; 313/326

[51] Int. Cl.[2] ..... H01J 35/04

[58] Field of Search ..... 313/60

[56] References Cited

UNITED STATES PATENTS 3,801,846 4/1974 Haberrecker ..... 313/60

*Primary Examiner*—R. V. Rolinec
*Assistant Examiner*—Darwin R. Hostetter
*Attorney, Agent, or Firm*—Frank R. Trifari; George B. Berka

[57] ABSTRACT

A rotary-anode X-ray tube comprising means to adjust current density measured along a dimension $x$ of the focal spot of the electron beam on the anode such as to decrease in the direction of rotation of the anode according to $1/\sqrt{x}$.

4 Claims, 4 Drawing Figures

ROTARY-ANODE X-RAY TUBE

The invention relates to an X-ray tube having a rotary anode irradiated by an electron beam in a focal spot path.

The definition of radiographs made by means of such an X-ray tube as a source of radiation, is greatly dependent upon the width of the electron beam at its area of impact on the anode. Hence in known X-ray tubes endeavours are made to realize the smallest possible focal spot. However, a lower limit is set to the spot size because a sufficiently large radiation dose is to be generated and, in order to eliminate a high degree of anode material evaporation, high temperature-gradients in the anode surface must be avoided. The current density in the focal spot generally is made as uniform as possible or, as is described in German Patent Specification 1,165,769, it is attempted to make the current density greater at the edges of the focal spot than at the centre.

From a study by Bouwers, reported in "Fortschritte auf dem Gebiet der Röntgenstrahlen" 47 (1933), pp. 703 sqq., it is deduced for a stationary anode that with an upper limit to the locally permissible anode temperature the X-ray dose to be generated is a maximum if the loading of the anode measured in a time $t$ varies according to $1/\sqrt{t}$. In analogy with this current density distribution measured in time the inventors have calculated that for a rotary-anode disk, with corresponding limitations, optimum radiation output is obtained if the load distribution, measured in the travelling direction $x$ of the anode relative to the focal spot, varies as $1/\sqrt{x}$.

According to the invention an X-ray tube of the aforementioned type is characterized in that the electron beam impinges on the anode in a focal spot the intensity distribution in which, measured in the travelling direction of the anode relative to the focal spot, decreases from a maximum at least substantially according to $1/\sqrt{x}$.

The said load distribution enables a minimum focal spot width to be obtained for a maximum permissible local temperature and a given radiation dose. It has been found that thus not only can minimum focal spot width be obtained but also, in particular in respect of imaging small details, a considerably improved modulation transfer function is obtained. Consequently, an X-ray tube according to the invention will enable radiographs having a considerably higher definition to be made.

Figure 1:
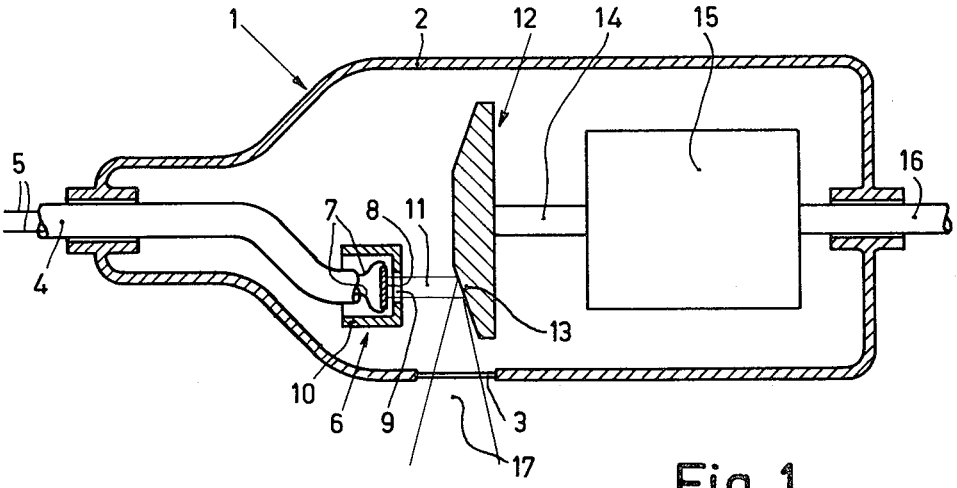
Figure 2:
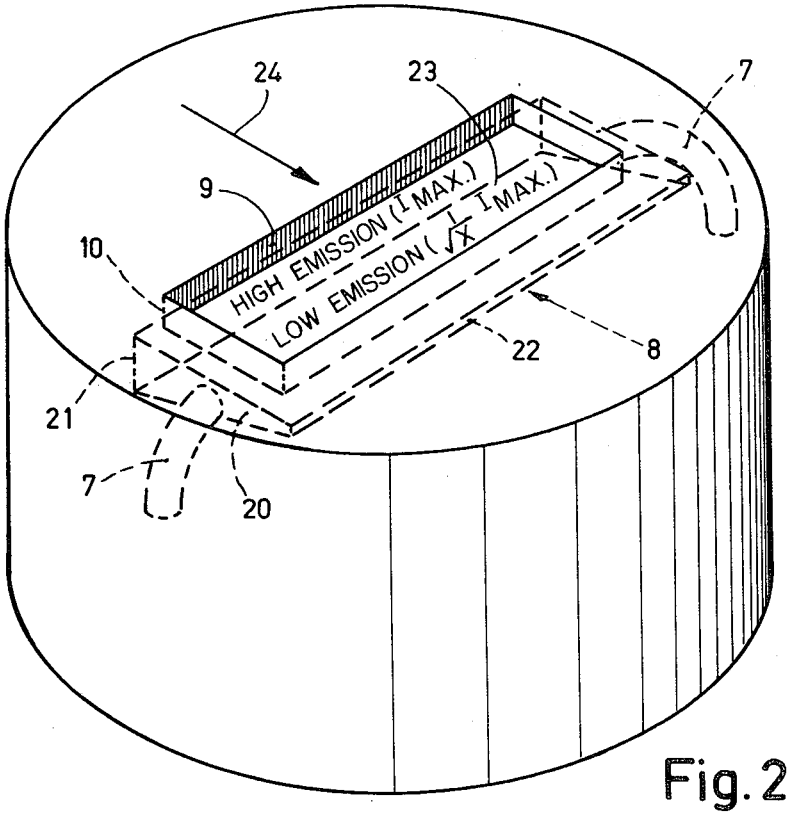
Figure 3:
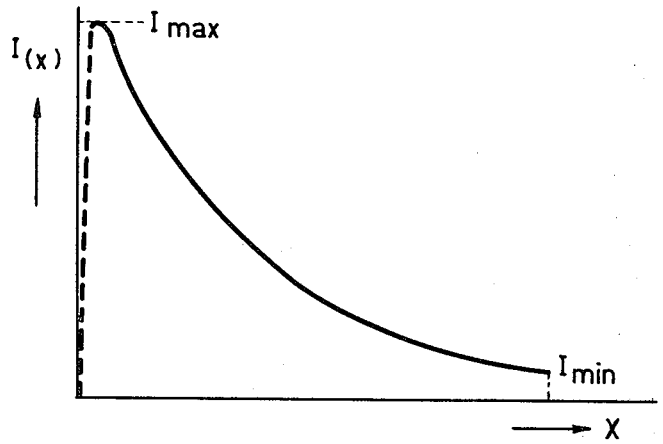
Figure 4:
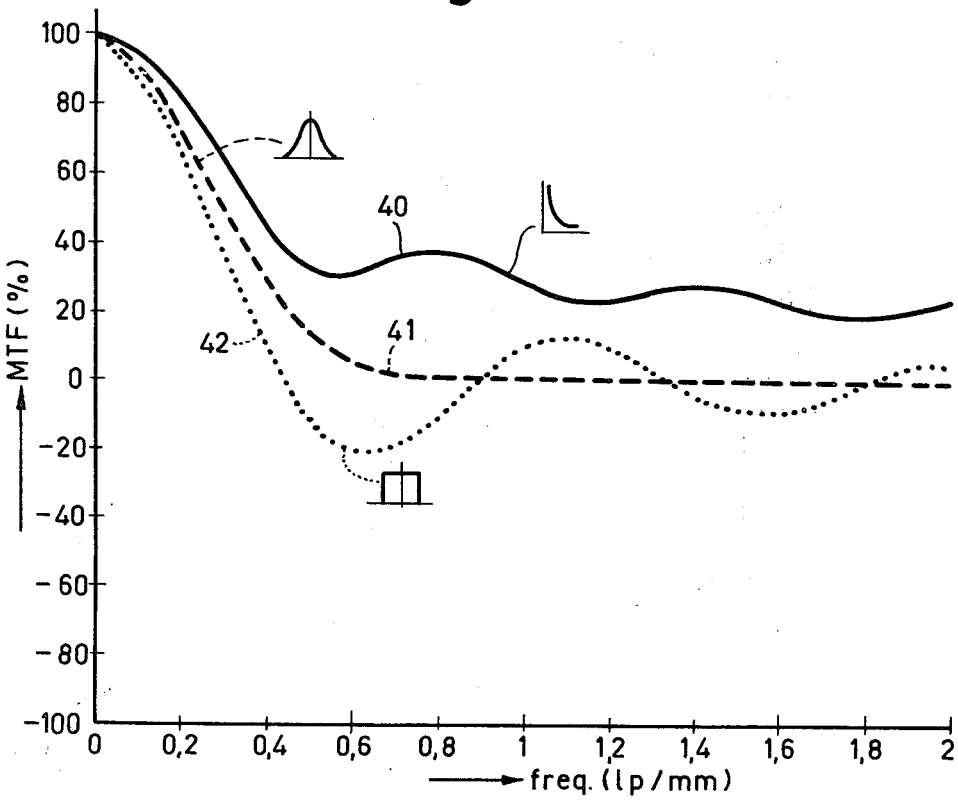

Hereinafter preferred embodiments of the invention will be described more fully with reference to the accompanying diagrammatic drawings, in which FIG. 1 shows schematically a preferred embodiment of an X-ray tube according to the invention, FIG. 2 is a schematic perspective view of a cathode for use in an X-ray tube according to the invention, FIG. 3 is a graph illustrating the current density distribution in the focal spot of an X-ray tube according to the invention, and FIG. 4 is a graph which for a few current density distributions in the focal spot shows the modulation transfer function as a function of frequency.

Referring now to FIG. 1, an X-ray tube 1 has a tube wall 2 in which are provided an X-ray exit window 3 and a bushing 4 for supply leads 5 for a cathode 6. The cathode 6 comprises a filament 7 an emissive part 8 of which is, for example, a strip of cathode material having a section which tapers in the direction of width. In operation the strip 8 through a slit 9 in a cathode sleeve 10 emits an electron beam 11 which is accelerated towards an anode 12 and impinges thereon in a focal spot 13. The anode 12 is rotated via a shaft 14 by a driving device 15 at a speed of, say, 9,000 revolutions per minute. Supply leads for the anode driving device are led in through a bushing 16 in the tube wall 2. Owing to the rotation of the anode 12 the focal spot 13 describes a circular path, and a beam of X-rays 17 is generated which emerges through the window 3. In rotary-anode tubes of the type described the cathode may be double, comprising for example two adjacent strips 8 and slits 9. The focal spot paths of the two electron beam sources may then be two concentric circles on the anode. Thus different object points for the X-ray beam may be chosen or, when the anode disk is composed of portions of different materials, X-rays of different wavelengths may be generated.

FIG. 2 is a perspective view to an enlarged scale of part of the cathode 6. The strip 8 may have a length of a few mm, a width of about 0.1 mm and a thickness which tapers from about 0.1 mm to 0.01 mm. These dimensions are given only to fix ideas and may be adapted to the construction of a practical X-ray source in all-respects. The filament current in its passage through the strip is distributed over the cross-sectional area 20 thereof so that the current density is the same at all points. Because a face 21 of the strip is thicker than a face 22, in the stationary state a temperature gradient will occur in a direction at right angles to the strip so that the strip will assume a higher temperature near the face 21 than near the face 22. As a result, the emission of an emissive surface 23 will be higher near the face 21 than near the face 22. With proper proportioning of the strip, see Zwikker in his dissertation, Amsterdam, 1926, an emission density is obtainable which has a variation approximating to a curve $1/\sqrt{x}$, where $x$ is measured in the direction of width of the strip. Making the strip 8 longer than the slit 9 enables the connections of the strip to the supply leads 7 to be disposed behind the cathode sleeve 10 so as to avoid disturbing edge effects. The anode disk rotates in the direction indicated by an arrow 24. This direction of rotation must always be maintained, because otherwise an inverse density distribution in the focal spot is produced, which obviously will be detrimental to the image quality. When an electron beam having a density distribution according to $1/\sqrt{x}$ impinges on the anode, the layer is locally heated so that under the focal spot an approximately isothermal region is produced. In an X-ray tube according to the invention it is not attempted, as is doen in known X-ray tubes, to achieve uniform current density in the electron beam, but to obtain uniform temperature distribution under the focal spot. Because the locally highly increased temperature is responsible for the destruction of the anode disk, either a longer useful life or a higher local loading and hence either a higher radiation dose or a narrower spot are obtainable.

In the above-described embodiment a temperature gradient is produced across the strip 8 by differences in thickness of the material in the direction of width. A corresponding temperature gradient is obtainable in an indirectly heated strip of uniform thickness by causing the heat transfer from the heater element to the strip to vary in the width direction. This is obtainable, for example, by disposing a heater element beneath the strip at an angle thereto or by providing a thermal contact along a longer edge of the strip only. The emission density may alternatively be varied by varying the work function of the emissive material in the direction of width of the surface 23 of the strip.

In another preferred embodiment the current density distribution is obtained by electron optical means which produce a field strength gradient at the emissive surface.

FIG. 3 is a graph showing current density distribution in a focal spot according to the invention. From a value $I_{max}$ the current density decreases with decrease of $1/\sqrt{x}$ to a minimum value $I_{min}$. The two extreme values are determined by practical considerations. On the one hand, an infinitely high current density for $x=0$ has no practical significance, and on the other hand such an extended tail at the low-intensity end provides no real contribution to the X-ray dose to be generated. Within a ratio of, say, a factor of 10 between $I_{max}$ and $I_{min}$ the theoretic optimum distribution can be satisfactorily approximated to.

FIG. 4 is a graph in which the modulation transfer function (MTF) for a focal spot having a current density distribution according to the invention is plotted as a function of frequency, which is measured as a number of lines per mm, resulting in a curve 40. For an otherwise equal situation this function is also shown for a Gaussian distribution curve 41 and for a uniform distribution curve 42. In the region in which the curve 42 descends below the zero line there is an apparent resolving power, because in this region the modulation in the image and that in the object are opposite. This situation does not arise in the distribution according to the invention. FIG. 4 clearly shows that for the intensity distribution or leading according to the invention the MTF is better than for known distributions over the entire frequency range but particularly for frequencies of more than 0.5 lines per mm. In plotting the curves of FIG. 4 edge effects have been neglected, in other words a focal spot has been considered the length of which is large relative to the width, for example that produced by an X-ray source as described with reference to FIGS. 1 and 2. However, the invention is not restricted thereto and a current density distribution as illustrated in FIG. 3 can be approximated to for a focal spot of different section, for example a circular spot, although the edge effects then will be greater and more difficult to reduce. To obtain such a circular spot, in a preferred embodiment a circular emitting disk is used which is disposed at an angle underneath the cathode sleeve in the direction of rotation of the anode.

In a further embodiment of the invention the cathode contains a support with a sleeve wherein an emitting wire is deposited. The surface of the support on both sides of the sleeve being on a mutually different high with respect to the anode. Thus a uniform wire results, if the geometry and the potentials are well choosen, in a current density for the electron beam impinging upon the anode having the desired distribution measured perpendicular to the sleeve.

What is claimed is:

1. An X-ray tube having a cathode for emitting an electron beam and a rotary anode to be irradiated in a focal spot by said electron beam, comprising means for producing a current density distribution, measured along a dimension $x$ of said spot in the direction of rotation of the anode, that decreases from a maximum value at least substantially according to $1/\sqrt{x}$.

2. An X-ray tube as claimed in claim 1, wherein said means is provided in said cathode for generating the electron beam.

3. An X-ray tube as claimed in claim 2, wherein the emitting element of the cathode comprises a strip the cross-sectional area of which tapers in a direction at right angles to the current flow direction, the anode moving, with respect to the focal spot, towards the thinner side of the strip.

4. An X-ray tube as claimed in claim 2, wherein the emitting element at the surface facing the anode consists of an emissive material the emissivity of which decreases in the direction of rotation of the anode.

* * * * *